US007710280B2

(12) United States Patent
McLellan

(10) Patent No.: US 7,710,280 B2
(45) Date of Patent: May 4, 2010

(54) FLAME DETECTION DEVICE AND METHOD OF DETECTING FLAME

(75) Inventor: Douglas McLellan, Dartmouth (CA)

(73) Assignee: Fossil Power Systems Inc., Dartmouth, Nova Scotia (CA)

( * ) Notice: Subject to any disclaimer, the term of this patent is extended or adjusted under 35 U.S.C. 154(b) by 175 days.

(21) Appl. No.: 11/797,966

(22) Filed: May 9, 2007

(65) Prior Publication Data

US 2007/0281260 A1 Dec. 6, 2007

Related U.S. Application Data

(60) Provisional application No. 60/799,666, filed on May 12, 2006.

(51) Int. Cl.
*G08B 17/12* (2006.01)

(52) U.S. Cl. ..... 340/578; 340/577; 250/554; 431/79

(58) Field of Classification Search ..... 340/577, 340/578, 584; 280/554; 431/79, 13, 78, 431/75; 250/574, 214 R, 216, 226, 239; 356/390, 328

See application file for complete search history.

(56) References Cited

U.S. PATENT DOCUMENTS

| | | | | |
|---|---|---|---|---|
| 4,983,853 | A | 1/1991 | Davall et al. | |
| 5,107,128 | A * | 4/1992 | Davall et al. | 250/554 |
| 5,424,554 | A * | 6/1995 | Marran et al. | 250/554 |
| 5,926,280 | A * | 7/1999 | Yamagishi et al. | 356/390 |
| 6,060,719 | A * | 5/2000 | DiTucci et al. | 250/554 |
| 2005/0266363 | A1 * | 12/2005 | Ganeshan | 431/79 |

* cited by examiner

*Primary Examiner*—Anh V La
(74) *Attorney, Agent, or Firm*—Nixon & Vanderhye P.C.

(57) ABSTRACT

A device and method for detecting flame using real-time continuous imaging and pattern recognition of infrared (IR) images of a flame region. Infrared emissions radiated from the region pass through a wide field-of-view lens and are detected by a Charged-Coupled Device (CCD) array sensitive to the near IR range. The system then digitizes the image, extracts characteristic parameters from the measurement and stores both the image and characteristic information for pattern recognition. To accomplish the pattern recognition function, the derived real-time characteristics of the current measurement are statistically compared to pre-stored patterns representative of images of radiation emitted from the region while known flame conditions prevail within the region. Based on this comparison, an assessment is made to determine the presence or absence of flame. The characteristic measurements are also used for evaluating the quality of flame.

13 Claims, 7 Drawing Sheets

FLAME DETECTION DEVICE AND METHOD OF DETECTING FLAME

This application is a U.S. utility application claiming priority to U.S. Provisional Application No. 60/799,666 filed 12 May 2006, the entire content of which is incorporated herein by reference.

FIELD OF INVENTION

The present invention relates to a device and a method for detecting flame in furnace and burner systems. In particular, the present invention relates to a device and a method designed to digitally monitor, in real time, the presence or absence of flame in commercial and industrial furnaces.

BACKGROUND OF THE INVENTION

Multiple burners are widely employed in industrial boilers, such as those used in conjunction with steam turbines for electric power generation. These burners may be fired by a variety of fuels such as coal, oil or gas and usually have an associated supporting igniter for initial combustion of the fuel. It is necessary to monitor the flame on these burners to ensure that flame is present at all times during the operation of the burner. In the event of a flame failure, a burner may continue to supply fuel resulting in a potentially hazardous situation. Occasionally, a burner may not ignite upon start up. Therefore, it is required that such conditions be immediately identified and prompt remedial action taken.

Over the years, a variety of flame detection devices for monitoring burner fires and for providing an output based on the presence or absence of flame have been developed and employed. A well known detection method is to use an optical device to examine the light emitted from the flame. A typical optical flame device consists of a light sensitive sensor that generates a time varying voltage when exposed to light. In most prior art flame detection devices, the sensor is a single discrete element, allowing only the overall light intensity to be represented in the spatial region of interest.

Several techniques have been developed to examine sensor output and control the burner system. Such conventional systems directly process the magnitude of time varying output voltage of the sensor, which is directly proportional to the light intensity. As the light intensity increases, so does the magnitude of the output voltage. This level is analyzed to determine the presence or absence of flame on the burner of interest.

Devices employing this technique and variations thereof have several disadvantages. For instance, in multiple burner systems, a flame sensor is placed on each burner and tuned to detect the flame of that particular burner only. Often the background flame from adjacent burners will have the same or greater intensity as that of the burner of interest. This background intensity may cause the output of the optical sensor to remain at a level expected in the case when flame is present, even though the burner may be shut down. The detector will then incorrectly indicate the presence of flame. This is a common problem, since conventional detectors have difficulty with flame discrimination under these circumstances.

Improvements in flame detection results have been obtained by post processing the time varying output into the frequency domain and then analyzing the frequency spectral characteristics of the flicker rather than the limited time domain voltage, as disclosed by Davall et al. in U.S. Pat. Nos. 4,983,853 and 5,107,128. However, the sensor used in this method is a single discrete element, and only allows for the overall light intensity to be detected in a defined spatial region.

Additionally, such conventional devices do not have the ability to sense multiple fuels due to spectral wavelength limitations of the individual sensors. If the fuel type is changed, the sensor must be switched to detect the different ultraviolet, visible or infrared spectra associated with the new fuel.

There is accordingly a need for an improved system that overcomes the limitations associated with using a single elemental optical flame detector, particularly the deficiencies found in their flame discrimination capability, and thereby increase the user's confidence level in the detection of flame in industrial scale fuel burner applications.

SUMMARY OF THE INVENTION

An object of the present invention is thus to provide an improved device for detecting flame in furnace and boiler systems, such as a multi-burner system in a combustion unit.

According to an aspect of the present invention there is provided a flame detection device comprising a detector for detecting radiation from a flame region and for capturing images of the flame region at any given instant in time, a memory for storing the captured images and for storing known characteristics of flame, and a processor for extracting characteristic statistical patterns of the real time images and for comparing the characteristic statistical patterns of the real time images to known characteristics of flame so as to determine a confidence level for presence of flame.

In one embodiment of the present invention, the detector comprises a light detection section containing a wide angle lens, a filter for attenuating light to within the dynamic range of an imager that captures images of the radiated light at any given instant in time. The processor may comprise means for execution of evaluation logic on the images to evaluate confidence level for presence of flame, and means to output flame status data.

The detector may further comprise viewing optics and an imager for operation in ultraviolet, visible, infrared wavelengths and combinations thereof. The imager may be a Charge-coupled Device (CCD) or the like. In an embodiment of the present invention, the range of operation of the viewing optics and the imager is in the near infra-red wavelength region.

According to another aspect of the present invention, there is provided a method for flame detection comprising the steps of: detecting radiation from a flame region, capturing images of the flame region at any given instant in time, extracting characteristic statistical patterns of the real time images, comparing the characteristic statistical patterns from the real time images to known good patterns, evaluating a confidence level for presence of flame, and displaying the resultant images and statistical data.

The evaluation operation may include storage of multiple images extracted at different time intervals obtained by the imager and the execution of a statistical recognition routine using a combination of multiple real time images compared against pre-stored known good representative flame pattern.

The statistical recognition routine may include analysis of the spatial, temporal and energy features of the burner flame thereby providing a confidence level, indicating the likelihood of flame presence. The analysis may be updated continuously at predetermined time intervals to effectively provide a moving time-window of a predetermined length over which confidence level is accumulated.

The resultant confidence level may be compared against a known threshold level, and an output may be generated to indicate the presence of flame.

In an embodiment of the present invention, the device may be capable of presenting image output for qualitative analysis of the flame. In this embodiment the system will further include an external software application which will allow for a visual display of the captured images, and all evaluation statistics derived from the images. The information regarding flame dynamics may then be used for qualitative analysis of the burner flame combustion. Profiles of each burner in the combustion unit may be stored over a time period. These may then be compared and linked to burner operating conditions to evaluate quality of flame.

The external software application may also be used as a tool for configuring and tuning the flame detection device. The external software application may display a mimic of the burner layout of the boiler system with an overview of all flame detection device results.

BRIEF DESCRIPTION OF THE DRAWINGS

The description of the embodiment that follows illustrates a possible application of the present invention in a boiler furnace, whereby.

DETAILED DESCRIPTION OF THE INVENTION

Figure 1:
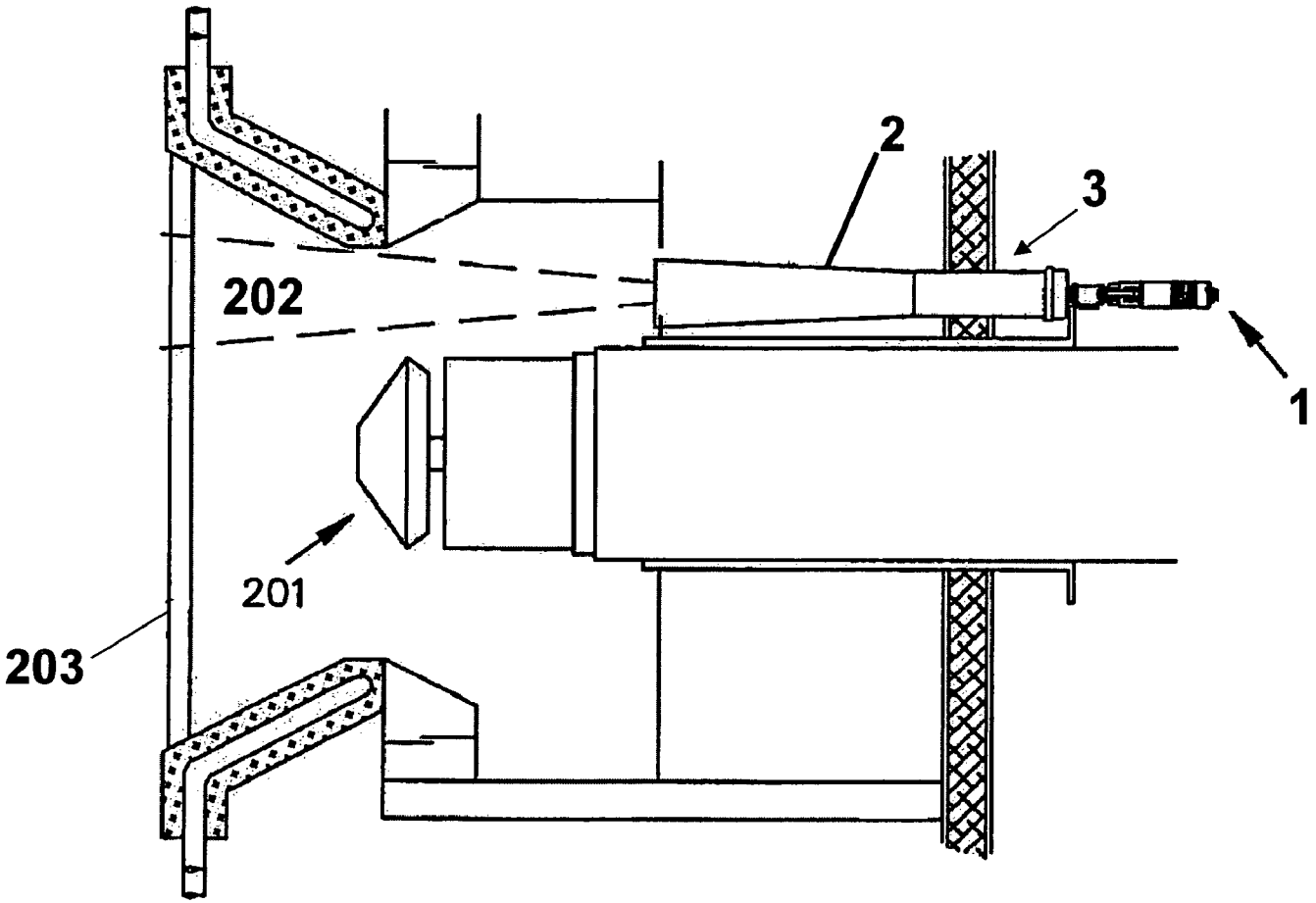
FIG. 1 is a longitudinal cross-sectional illustration of a burner system monitored by a flame detection device according to an example of an embodiment of the present invention.

As illustrated in FIG. 1, a flame detection device 1 is positioned at a proximal end of a sighting tube 2. The sighting tube 2 and its associated viewing optics are constructed using conventional methods, for instance, according to the disclosure of U.S. Pat. No. 5,107,128. As illustrated, the sighting tube 2 is positioned within a burner viewing port 3 of a boiler furnace, such that the distal end of the sighting tube 2 is in the vicinity of a flame spot 202 associated with a burner 201. For simplicity in illustration, a single burner 201 is shown in FIG. 1. However, the flame detection device of the present invention may be employed in multiple burner systems as well.

Figure 2:
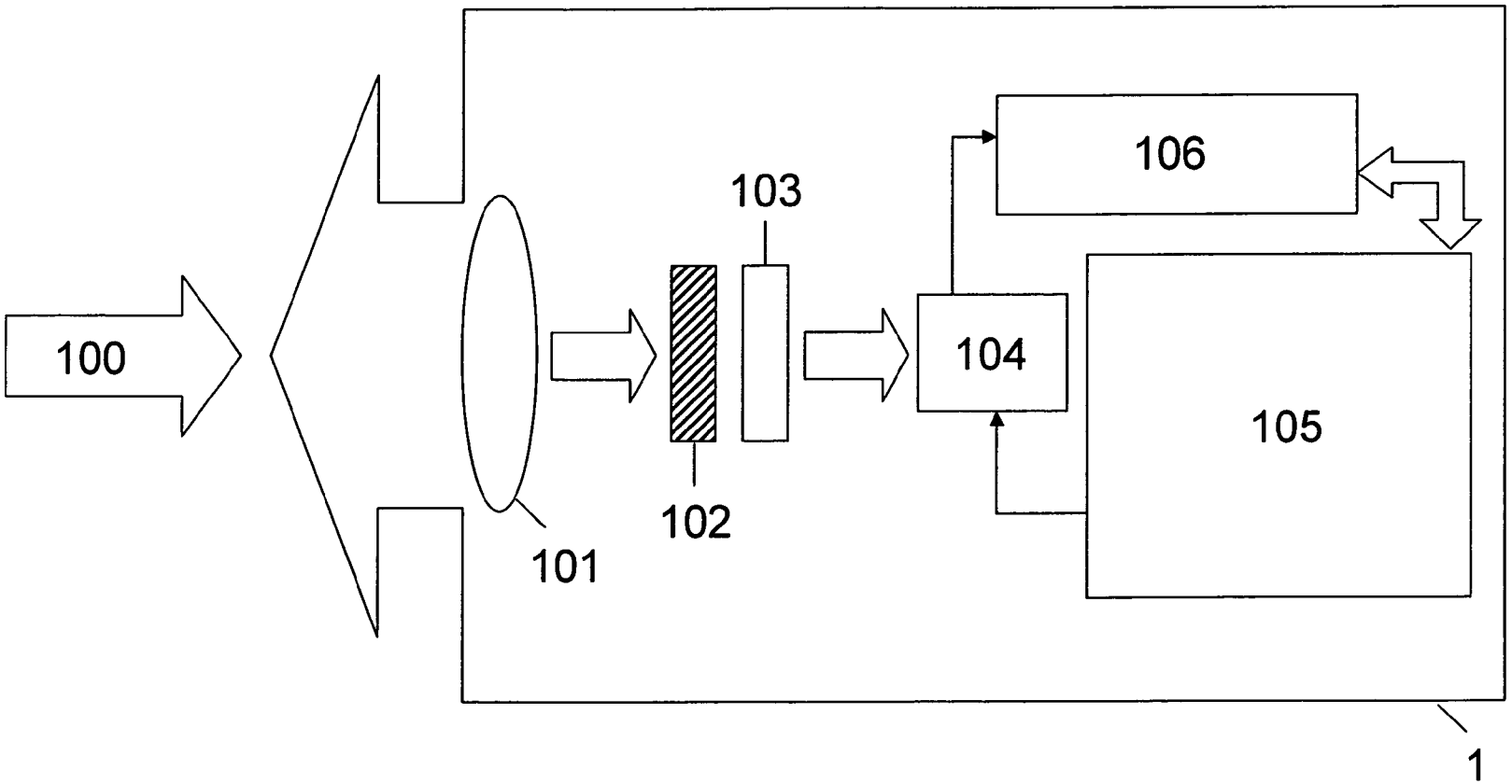
FIG. 2 is a block diagram illustrating components of an example of a flame detection device according to the present invention.

An exemplary embodiment of the flame detection device 1 according to the present invention will now be described in detail with reference to FIG. 2. The incident flame 100 represents the flame spot 202 (as viewed through the sighting tube 2 shown in FIG. 1) in the line of sight of the flame detection device 1, and includes flame from the burner of interest as well as any background flame. Radiation from the flame incident on the lens 101 is focused through a narrow bandpass IR filter 102 onto a CCD imager 103. A sapphire lens is advantageously used as lens 101 as it provides good transmittance characteristics over the full optical range of interest. It also provides additional filtration of UV and far IR radiation. The IR filter 102 further removes sources of UV radiation, and limits IR radiation emitted from the flame to within a sufficient spectral window to ensure intactness of the flames spatial, temporal and energy characteristics and to be clearly imaged by the CCD imager 103.

Although the flame detection device described herein employs viewing optics and a CCD imager within near IR wavelengths, other arrangements operating with wavelengths in ultraviolet, visible and combinations of ultraviolet, visible, and infrared may be used. Other suitable imaging devices such as CMOS devices may also be employed. The principle of detection and processing remain the same, only functioning at a different wavelength of light determined by the appropriate optics, filter and imager.

The presence of flame in the context of the entire specification refers to the existence of flame along with determination that the flame viewed by the sensor belongs to the local target burner and is not background radiation from adjacent burners in the furnace, unless otherwise stated.

Figure 2A:
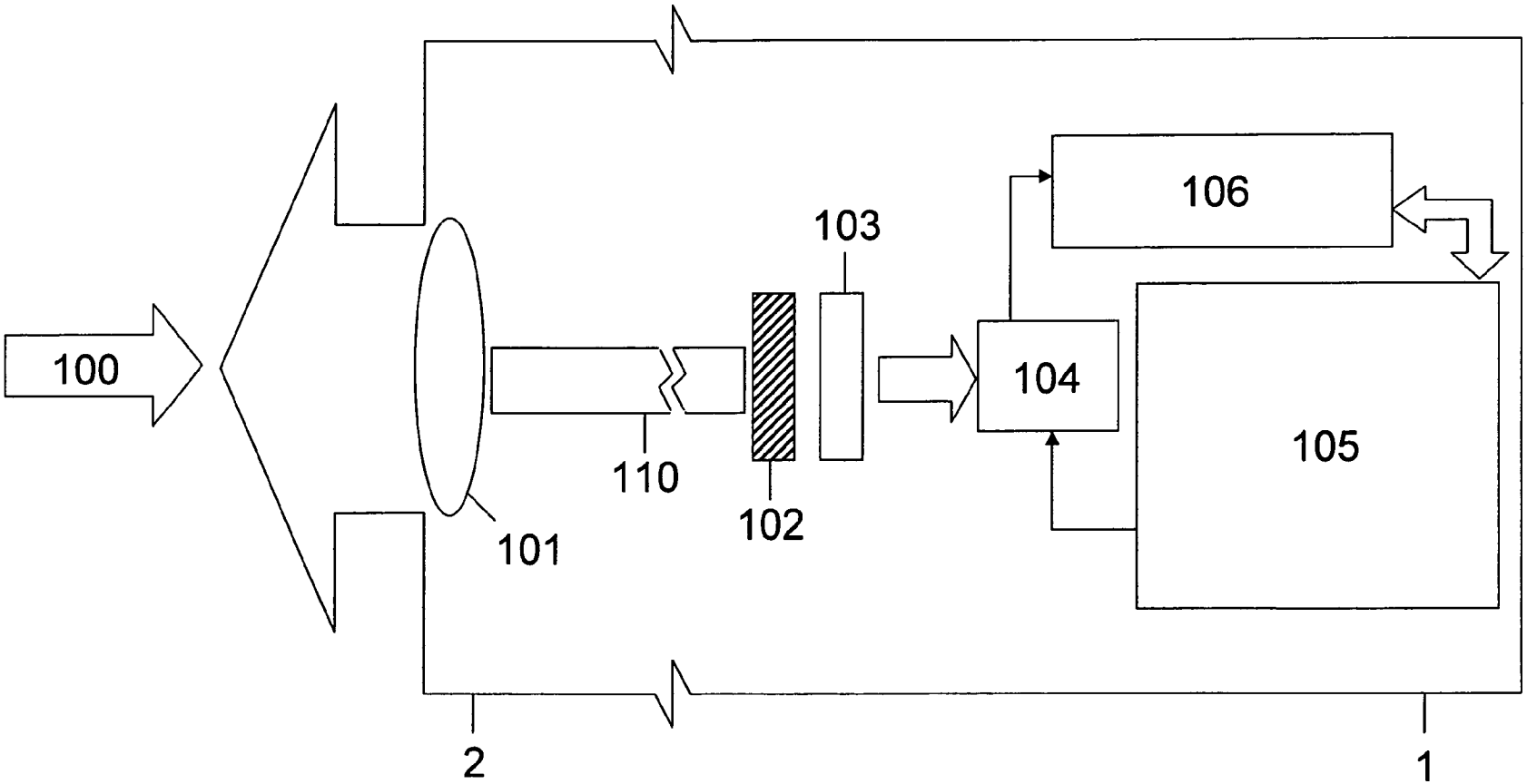
FIG. 2*a* is a block diagram illustrating components of a second example of a flame detection device according to the present invention.

The flame position may, on occasion, flicker and move out of the field of view of the lens 101 which may be limited by the sighting arrangement. In order to overcome the problems associated with line of sight, an alternate means to transmit radiation incident on the lens 101 onto the CCD imager 103 may be provided. For example, coherent light fiber optics can be used to position the viewing optics at the front of the sighting tube 2, allowing light to be collected over wider angles. In this case, a fiber optics bundle 110 is positioned between the lens 101 and the IR filter 102. When using fiber optics, the sighting tube 2 is extended, and the lens 101 is moved to the distal end thereof (see FIG. 2*a*). The fiber optics focuses the light onto the IR filter 102 and thereon to the CCD imager 103. The fiber optics is used as a medium to transmit light passing through the lens 101 onto the CCD imager 103, which may be positioned several feet in distance from the viewing optics. The optic fiber may be chosen to pass the wavelengths of interest.

The Frame Capture Section 104 provides the necessary control signals for acquiring and digitizing the image output from the CCD imager 103, and also for storing the images in memory 106 local to the flame detection device 1. The control signals may also include signals for synchronizing the acquisition of the image to be in tune with the frame rate requirements of Processing Section 105. Flame images are obtained at such a rate that flame conditions, particularly loss of flame, can be determined within a safe margin of time. In boiler systems, the flame detection device 1 will capture and process the images at a rate to satisfy the safety requirements of the boiler control system. For example, the frame capture rate may be 40 frames per second.

The Processing Section 105 comprises a DSP Microcontroller, a hybrid processor designed to handle both control and signal processing applications, and supporting logic. Several types of digital processors that can implement the functions of the flame detection device 1 are commercially available and may suitably be employed. For example, Freescale 56800/E family and Texas Instruments C2000 family of DSP microcontrollers may be employed as the DSP microcontroller. The DSP Microcontroller performs data processing for the entire flame detection device 1, which includes Frame Capture Section 104, memory 106, image processing, image evaluation operations, confidence level thresholding, and determination of presence or absence of flame. The DSP microcontroller may also communicate with external devices such as a computer 120 and/or an I/O device 107, shown in FIGS. 3 and 4, respectively.

Figure 4:
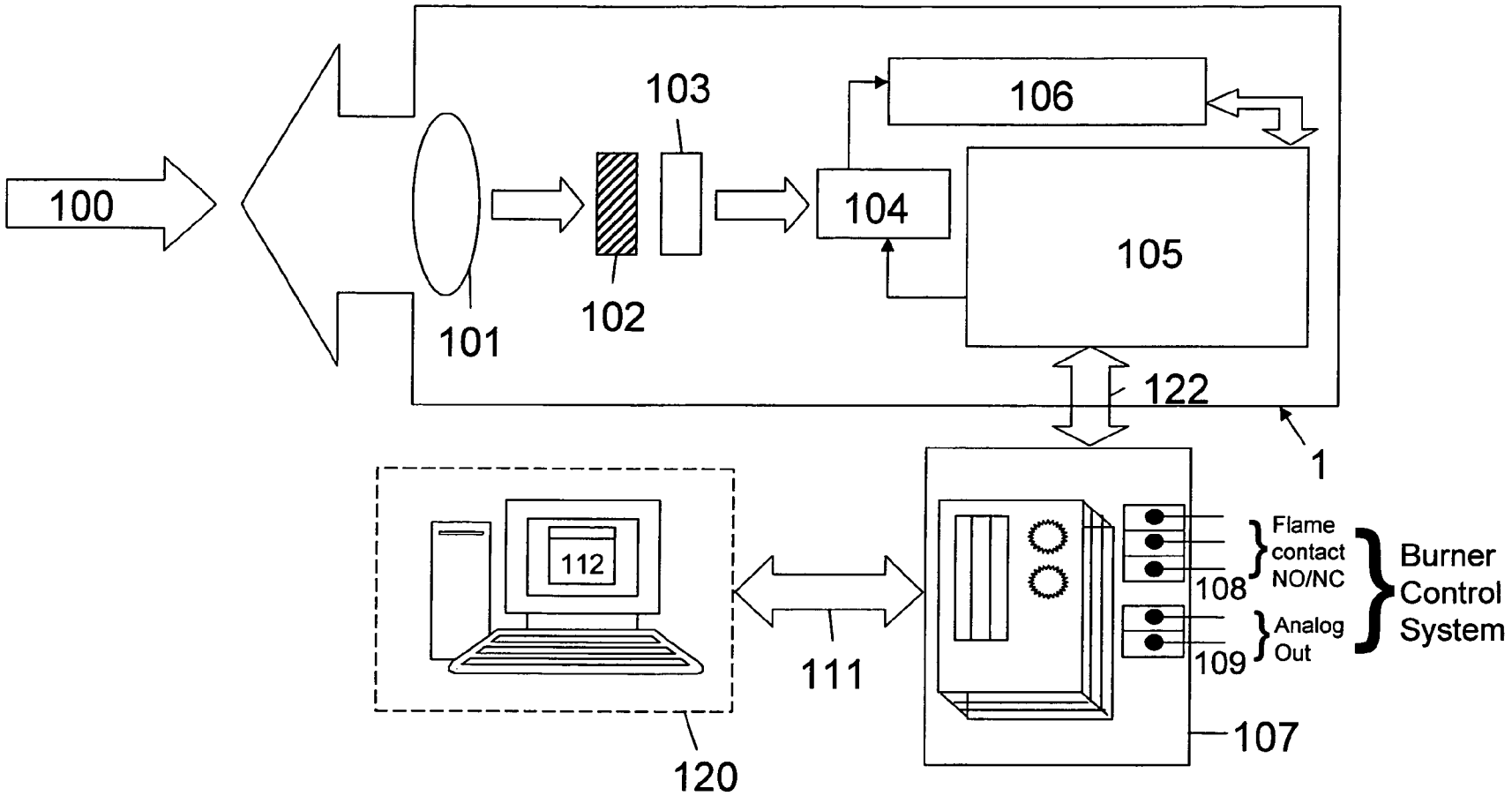
FIG. 4 is a block diagram of the flame detection device shown in FIG. 2 in communication with an I/O device.

As illustrated in FIG. 4, the DSP Microcontroller of the flame detection device 1 may send flame status data to an I/O device 107. In a typical multi-burner system, a dedicated I/O device 107 is provided for each flame detection device 1. Each flame detection device 1 is coupled to the respective I/O device 107 through a dedicated communication link 122.

The I/O device 107 supports the operation of a separate burner control system (not shown) by providing the required flame status relay output contacts 108. The I/O device 107 receives flame presence or absence status from the flame detection device 1 at regular intervals, and activates or deactivates the flame contact relay 108 (normally open (NO) and normally closed (NC) as shown in FIG. 4), accordingly. This output is monitored by the external burner control system for flame safety.

The I/O device 107 also receives the flame confidence level from the flame detection device 1 and outputs this as an analog signal 109 representative of the 0 to 100% range of the flame confidence result. The analog output may be a current loop, 4-mA, or a voltage, 1-5VDC. The I/O device 107 may also include a display panel 115, such as a LCD unit, to display the flame confidence level. The flame confidence level may be displayed as a bar graph.

Each of the individual I/O devices 107 of a multi-burner system are typically coupled via a communication link 111 to a computer 120. This link is independent of the individual dedicated communication links 122 between I/O devices 107 and flame detection devices 1, but may be shared by all I/O devices 107 and the computer 120.

The I/O device 107 activates its I/O controls based on the commands from the flame detection device 1 and passes through communication messages to and from the flame detection device 1 and the computer 120.

The computer 120 may be housed in a remote location and used as a monitoring station executing a software tool 112 developed in accordance with the present invention. The computer 120 is capable of executing the software tool 112 and communicating to the I/O device 107. The software tool 112 is used to monitor real-time flame images and the results of the image processing calculations sent from the flame detection device 1. The software tool 112 will also be used in the initial learn mode of the flame detection device 1 to select appropriate criteria to be used in the analysis based on viewing of the flame images obtained under known good burner flame conditions.

Figure 3:
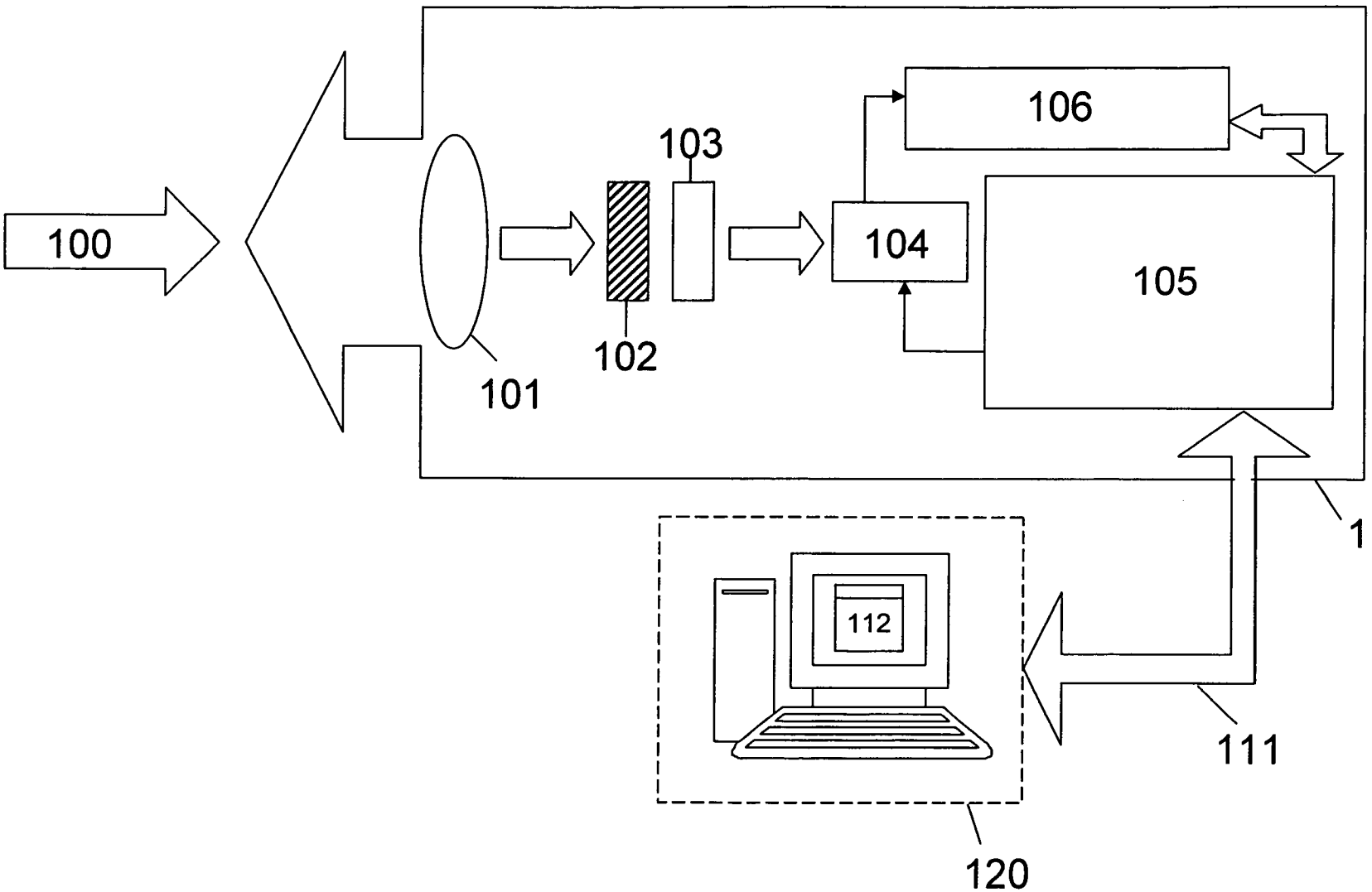
FIG. 3 is a block diagram of the flame detection device shown in FIG. 2 in communication with an external computer.

Under certain circumstances, the computer 120 may be in direct communication via the communication link 111 with the flame detection device 1 without employing the I/O device 107, as shown in FIG. 3. For instance, the flame detection device 1 and software tool 112 can be used together for qualitative processing of the images outside of flame decision making. The spatial and temporal distribution of flame front features would relate to occurrence and distribution of specific burner flame types. Profiles stored on the computer 120 for each burner in the multi-burner system of a combustion unit can then be used for comparison against each other to highlight flame quality issues.

Additionally, the software tool 112 may be used for remote tuning, control and monitoring of one or more flame detection devices 1. The software tool 112 may be configured for displaying a pictorial overview of all burner flame intensities, confidence levels and evaluation results displayed in the same matrix as the burner configuration of the boiler system. Furthermore, qualitative burner flame analysis along with logging and trending of burner flame conditions may be performed by the software tool 112.

Pattern Reference and Evaluation:

In general, a flame detection system will distinguish between the following flame conditions: main fuel flame from the burner being monitored, flame out condition on the burner being monitored, and background flame from other burners in the furnace. An approach is provided herein for distinguishing these conditions by using a technique of frame differencing, patterning current image frame characteristics from a reference set of image characteristics, and thresholding the result.

Figure 5:
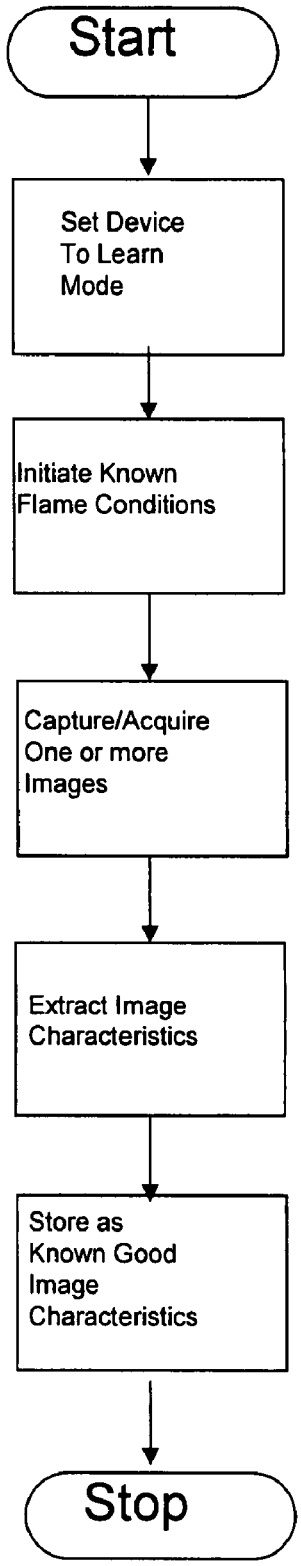
FIG. 5 is a flow chart illustrating a method of flame detection in learn mode according to an example of an embodiment of the present invention; and, FIG. 6 is a flow chart illustrating a method of flame detection in run mode according to an example of an embodiment of the present invention.

The reference set of image characteristics is obtained by operating the flame detection device 1 in a learn mode. As illustrated in the flow chart in FIG. 5, known good flame conditions for the burner 201 are set up in the field of view 202 of the flame detection device 1. A command is executed to place the device in learn mode from the software tool 112. In the learn mode, the flame detection device 1 captures and acquires one or more images of the burner flame within its field of view 202 in the Frame Capture Section 104. The Processing Section 105 extracts characteristics of the images and stores these characteristic measurements as being typical of good flame for that burner 201 in memory 106.

No single spatial, temporal or energy resolution is universally suitable for flame detection. Therefore, an approach is undertaken that allows for selection of criteria appropriate for a particular situation. With the flame detection device 1 in learn mode, graphic investigative aids provided on the software tool 112 can be adapted to identify the features best suited for distinguishing target flame dynamics from the background by highlighting regions of interest in the flame image and excluding or attenuating regions of lesser importance.

The flame detection device may also be adapted to learn characteristics of background flame. The background flame is often undesirable for proper flame detection and may impede the correct determination of flame status of a burner. The characteristics of the background flame may then be added to the pattern recognition criteria.

The results from the criteria selection developed in the learn mode is saved in the flame detection device 1 and used during the evaluation operations when the flame detection device 1 is placed in run mode. The computer 120 and software tool 112 are not required when the flame detection device 1 is in run mode and hence can be disconnected. However, the software tool 112, when in communication with the flame detection device 1, may be adapted for monitoring the actions and results of the flame detection device 1.

A command may be executed from the software tool 112 to place the flame detection device in the run mode. This is commonly the standard mode of operation. In run mode, the flame detector performs an evaluation operation which compares, through pattern recognition techniques, the latest flame images and their derived characteristics against the pre-stored learned characteristics.

The evaluation operation will include, but is not limited to, extracting spatial, temporal and energy features from the flame image stream. The criteria used draws from statistical and probabilistic inference. Spatial factors include mapping of flame area features. By detecting boundaries between key aspects of target flame front, edges may be used to increase weighting on prominent regions of flame. From the energy value of each flame image pixel a threshold can be set to filter out background flame components, as well as to determine pixel intensity distribution, mean, standard deviation and other statistical measures of pixel activity.

Since the flame detection device 1 is fully self-sufficient in the run mode, the actions preformed remotely on the computer 120 do not affect integrity or the decision making process thereof.

Figure 6:
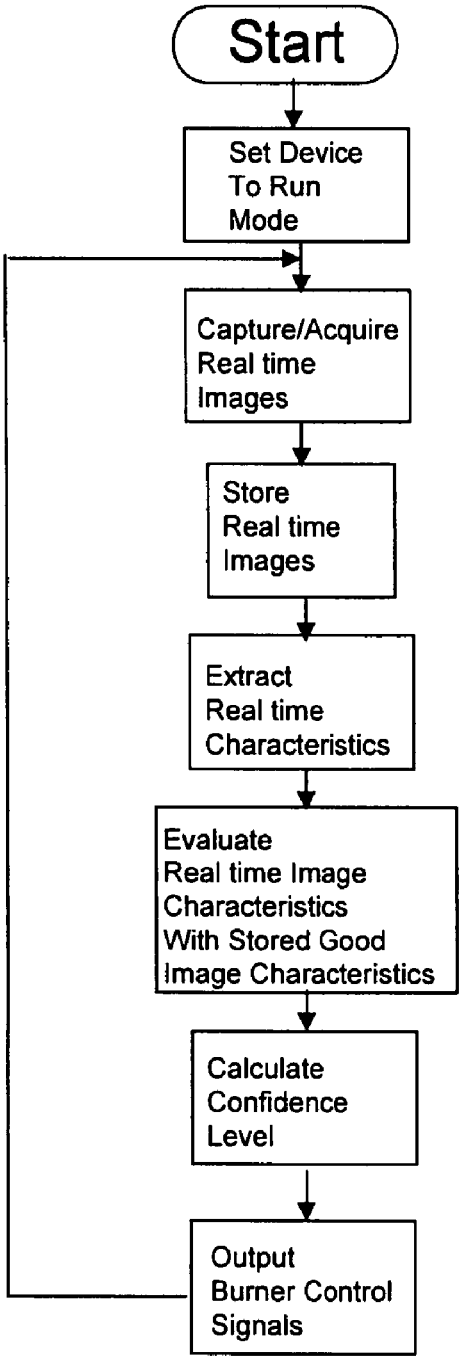

Flame Confidence Level Processing:

The calculated confidence level, or likelihood of flame presence, is a result of the sampling and analysis of several flame images as illustrated in the flowchart in FIG. 6. The initial calculation process occurs as follows: a full flame image is captured and acquired into local storage memory 106, evaluation operation is performed on the current image, and a pattern recognition operation is then performed against previously obtained patterns. The confidence level indicating likelihood of flame is then output.

Images of the burner flame are then captured at predetermined intervals. Intervals may be as small as one second, to effectively enable real time monitoring. Each subsequent image undergoes the same evaluation and pattern recognition operations as the first, resulting in a confidence calculation at each interval of time.

The current image confidence calculation along with several of the immediate past image confidence calculations are used to determine an overall computed confidence level. This smoothing of data results overcomes brief transitory movements of the target burner flame that do not actually indicate loss of flame. It also results in a moving analysis being performed, continuously updating the confidence level over a fixed window time.

The confidence level may be calculated from an aggregate of different flame feature measurements, with the calculated result then compared to a predetermined threshold to establish presence or absence of flame in the monitored burner.

The method of flame detection depends on characterizing the different flame conditions based on digitized images of the emitted radiation, and on calculating a confidence level, or likelihood of flame presence determined by evaluating a measure of fit between the latest images and previously stored characterizations.

The typical procedure followed to detect flame presence is as follows:

1. Select the burner operating range and conditions to be monitored.
2. Obtain characterizations of the flame conditions to be monitored.
3. Select the criteria to be used in the evaluation operation.
4. Capture a flame image, and obtain the frame characterization outputs by running the evaluation criteria against the current sample.
5. Compare the latest frame characterization outputs with the previously stored characterizations and obtain a confidence level, indicating a likelihood of flame presence.
6. Output flame condition to the I/O device.
7. Repeat steps (4) through (6).

As will be apparent to those skilled in the art, many alterations and modifications are possible in the practice of this invention without departing from the spirit of the essential characteristics thereof. The present embodiments are therefore illustrative and not restrictive.

I claim:

1. A flame detection device capable of detecting and discriminating flame from a local target burner from background radiation from an adjacent burner, said device comprising:

a detector for detecting radiation from a flame region, said detector comprising a light detection section containing viewing optics and an imager capable of operating in the ultraviolet, visible, or infrared wavelengths. or combinations thereof, for capturing real time images of multiple spatial, temporal and energy features of the radiation from the flame region;

a memory for storing the captured images and for storing known characteristics of a known flame; and a processor for extracting characteristic statistical patterns of the real time images and for comparing the characteristic statistical patterns of the real time images to the known characteristics of the known flame so as to determine a confidence level for presence of flame.

2. The flame detection device according to claim 1, wherein the imager is a multi-element device capable of capturing a plurality of infrared rays radiating from a flame region at a single instant in time.

3. The flame detection device according to claim 1, wherein the viewing optics comprises a lens and a filter for attenuating the light to within the dynamic range of the imager.

4. The flame detection device according to claim 1, wherein the processor comprises means for execution of evaluation logic on the images to evaluate confidence level for presence of flame, and means to output flame status data.

5. The flame detection device according to claim 3, wherein the lens is a wide angle lens.

6. The flame detection device according to claim 1, wherein the imager is a Charge-coupled Device (CCD) or a Complementary Metal-Oxide-Semiconductor (CMOS) device.

7. The flame detection device according to claim 1, wherein the imager is a Charge-coupled Device (CCD).

8. The flame detection device according to claim 1, wherein the range of operation of the viewing optics and the imager is in the near infra-red wavelength region.

9. A method for flame detection by a flame detection system capable of detecting and discriminating flame from a local target burner from background radiation from an adjacent burner, said method comprising the steps of:

capturing real time images of multiple spatial, temporal and energy features of radiation from a flame region using a detector, said detector comprising a light detection section containing viewing optics and an imager capable of operating in the ultraviolet, visible, or infrared wavelengths, or combinations thereof;

extracting characteristic statistical patterns of the real time images using a processor;

executing a statistical recognition routine on the characteristic statistical pattern data from the real time images using said processor to obtain a comparison with known good patterns of a known flame stored in a memory;

calculating a confidence level with said processor using the result of said statistical recognition routine and comparing the confidence level to a predetermined threshold to establish a likelihood of flame presence; and generating an output to indicate the presence or absence of flame.

10. The method according to claim 9, wherein multiple images at different time intervals are captured and a combination of multiple real time images are compared against the stored known good patterns in the statistical recognition routine.

11. The method according to claim 10, wherein the statistical recognition routine includes an analysis of the spatial, temporal and energy features of the flame.

12. The method according to claim 10, wherein the statistical recognition routine is executed at predetermined time intervals to provide a moving time-window of a predetermined length over which confidence level is accumulated.

13. The method according to claim 11, wherein the generated output includes said captured images and statistical data and is output to a display panel to indicate the presence or absence of flame.

* * * * *